United States Patent [19]

van Geffen

[11] 4,185,486

[45] Jan. 29, 1980

[54] ROTATABLE PIERCING TOOLS FOR FORMING BOSSED HOLES

[75] Inventor: Johannes A. van Geffen, Apeldoorn, Netherlands

[73] Assignee: Technisch Handels- en Adviesbureau van Geffen B.V., Apeldoorn, Netherlands

[21] Appl. No.: 961,707

[22] Filed: Nov. 17, 1978

[30] Foreign Application Priority Data

Nov. 17, 1977 [NL] Netherlands ..... 7712700

[51] Int. Cl.[2] ..... B21D 28/36

[52] U.S. Cl. ..... 72/71; 72/112; 72/479

[58] Field of Search ..... 72/71, 325, 112, 479, 72/273, 342; 10/141 R; 408/57, 59, 226, 18; 29/157 T

[56] References Cited

U.S. PATENT DOCUMENTS

| | | | |
|---|---|---|---|
| 1,951,078 | 3/1934 | Wright et al. | 72/342 |
| 1,963,320 | 6/1934 | Wright | 72/342 |
| 2,240,840 | 5/1941 | Fischer | 408/18 |
| 3,429,171 | 2/1969 | Feher | 72/325 |
| 3,541,831 | 11/1970 | Simonton | 72/273 |
| 3,559,445 | 2/1971 | Hougen | 72/325 |

*Primary Examiner*—Lowell A. Larson

*Attorney, Agent, or Firm*—Diller, Ramik & Wight

[57] ABSTRACT

A rotary piercing tool for forming, in a metal plate or the wall of a metal tube, by pressure and friction-generated heat a bossed hole, said tool comprising a tapered active end portion at one end, a shank for its attachment in a chuck of a machine tool at the other end and a coaxial cavity extending from the free end of said shank to a place at a given distance from the free end of said active end portion.

5 Claims, 3 Drawing Figures

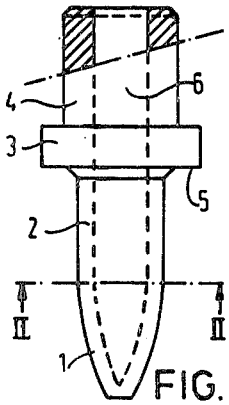
FIG. 1
FIG. 2
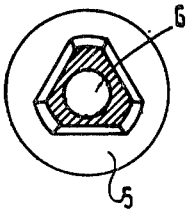
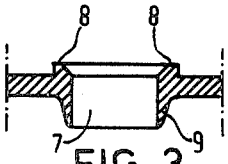
FIG. 3

ROTATABLE PIERCING TOOLS FOR FORMING BOSSED HOLES

The invention relates to a rapidly rotatable piercing tool for forming, substantially by frictional heat and pressure, a hole surrounded by a boss in a metal plate or the wall of a metal tube, said tool having a tapered first portion, a second portion adjoining said first portion coaxially and having a shape which is adapted to the shape of the hole to be formed, a third portion adjoining the second portion coaxially and a shank adjoining the third portion coaxially and meant for the attachment of the tool in a machine tool, which is provided with a rotatable spindle. Such a piercing tool is known form the Dutch patent application No. 7217160 laid open for public inspection.

Piercing tools of this kind present the feature that, when it is frequently used, the surface of the active part becomes cracked and even crumbles away locally. This is detrimental to the quality of the hole to be formed and to the length of life of the piercing tool.

The cause of this phenomenon are thermal stresses as a result of the great temperature gradient in the piercing tool during operation, whereby great differences in expansion in various places in the material of the tool occur. This disadvantage increases as the diameter of the tool is greater.

According to the invention the said problem is solved by the provision of a piercing tool having a coaxial cavity extending from the free end of the shank to a place at a given distance from the free end of the first portion and having such a shape as to ensure that the wall surrounding said cavity has in all places at least a predetermined thickness.

In order to guarantee the required mechnical strength, the thickness of the wall surrounding the coaxial cavity may be made at least 3 mm.

Experiments have shown that optimal results are achieved when in substantially all respective cross sectional areas of the piercing tool the ratio between the diameter of the cavity and that of the circumscribed circle of the tool lies between 0.5 and 0.7.

Furthermore, the distance between the free end of the first portion of the piercing tool and the inner end of the cavity may advantageously be at least 8 mm.

Now, the invention will be elucidated with the aid of the drawing of an embodiment. In the drawing are:

FIG. 1 partly an axial sectional view, partly an elevational view of a piercing tool according to the invention;

FIG. 2 a cross sectional view taken on line II—II in FIG. 1, and

FIG. 3 a cross sectional view of a part of a plate, in which a hole has been formed with the aid of a piercing tool illustrated in FIGS. 1 and 2.

The piercing tool shown in FIGS. 1 and 2 consists of a tapered portion 1, a substantially prismatic second portion 2, a head or third portion 3, of which the diameter is greater than that of portions 1 and 2, and a shank 4 for the attachment of the piercing tool in a machine tool having a rotatable spindle. The third portion 3 of the tool is provided on its side facing the second portion 2 with a profiled shoulder 5. A coaxial cavity 6 extends from the free end of the shank to a place at a given distance from the free end of the first portion. The prismatic second portion 2 defines the inner shape and the dimensions of the hole 7 to be formed (see FIG. 2), whereas the shoulder forms the place and the shape of the head face 8 of the formed boss 9.

The cross sectional areas shown in FIG. 2 of portions 1 and 2 have each the shape of an equilateral triangle having rounded off corners.

What I claim is:

1. A rapidly rotatable piercing tool for forming, substantially by frictional heat and pressure, a hole surrounded by a boss in a metal plate or the wall of a metal tube, said tool having a tapered first portion, a second portion adjoining said first portion coaxially and having a shape, which is adapted to the shape of the hole to be formed, a third portion adjoining the second portion coaxially and a shank adjoining the third portion coaxially and meant for the attachment of the piercing tool in a machine tool, the piercing tool having in addition a coaxial cavity which extends from the free end of the shank to a place at a given distance from the leading end of the first portion and has such a shape as to ensure that the wall surrounding said cavity has in all places at least a predetermined thickness.

2. A piercing tool according to claim 1, in which the thickness of the wall surrounding the coaxial cavity is at least 3 mm.

3. A piercing tool according to claim 1 or 2, in which in substantially all cross sectional areas of the first and the second tool portion the ration between the diameter of the cavity and that of the circumscribed circle of the tool lies between 0.5 and 0.7.

4. A piercing tool according to claim 1 or 2, in which the distance between the leading end of the first portion of the tool and the inner end of the cavity is at least 8 mm.

5. A piercing tool according to claim 3 in which the distance between the leading end of the first portion of the tool and the inner end of the cavity is at least 8 mm.

* * * * *